US009714068B1

(12) United States Patent
Greer

(10) Patent No.: US 9,714,068 B1
(45) Date of Patent: Jul. 25, 2017

(54) CANOPY FOR WATERCRAFT

(71) Applicant: Lawrence A. Greer, Bay Minette, AL (US)

(72) Inventor: Lawrence A. Greer, Bay Minette, AL (US)

(73) Assignee: George L Williamson, Fairhope, AL (US)

( * ) Notice: Subject to any disclaimer, the term of this patent is extended or adjusted under 35 U.S.C. 154(b) by 0 days.

(21) Appl. No.: 14/869,385

(22) Filed: Sep. 29, 2015

(51) Int. Cl.

| | |
|---|---|
| ***B63B 17/02*** | (2006.01) |
| ***E04H 15/02*** | (2006.01) |
| ***E04H 15/06*** | (2006.01) |
| ***E04H 15/58*** | (2006.01) |

(52) U.S. Cl.
CPC ..... *B63B 17/02* (2013.01); *E04H 15/02* (2013.01); *E04H 15/06* (2013.01); *E04H 15/58* (2013.01)

(58) Field of Classification Search
CPC ..... E04H 15/02; E04H 15/06; E04H 15/322; E04H 15/40; E04H 15/44; E04H 15/58; E04H 2015/328; B63B 17/02; A47C 7/66
See application file for complete search history.

(56) References Cited

U.S. PATENT DOCUMENTS 494,333 A * 3/1893 Hill ..... A45B 11/00 135/151
3,371,671 A * 3/1968 Kirkham ..... E04H 15/06 135/116
3,394,720 A * 7/1968 Moss ..... E04H 15/003 135/118
D218,923 S * 10/1970 Shafer ..... D12/402
4,068,673 A * 1/1978 Bernardi ..... E04H 15/003 135/139
4,300,798 A 11/1981 Musgrove et al.
4,641,883 A 2/1987 Kato
5,287,872 A * 2/1994 Anderson ..... E04H 15/26 135/20.1
5,638,849 A 6/1997 Scott
6,227,557 B1 * 5/2001 Perret ..... B62J 17/08 135/88.01
D461,160 S * 8/2002 Araki ..... D12/402
6,827,094 B1 * 12/2004 Bramwells ..... E04H 15/58 135/115
6,845,780 B2 1/2005 Bishirjian
6,926,355 B2 * 8/2005 Le Gette ..... A47C 7/66 297/129

(Continued)

FOREIGN PATENT DOCUMENTS

AT 412891 B * 8/2005 ..... E04H 15/003
DE 102009020795 * 11/2010 ..... A45B 23/00
FR 2884844 A1 * 10/2006 ..... E04H 15/003

*Primary Examiner* — David R Dunn
*Assistant Examiner* — Danielle Jackson
(74) *Attorney, Agent, or Firm* — George L Williamson

(57) ABSTRACT

Method and apparatus for a canopy for watercraft wherein the canopy is constructed by using a pair of flexible, rod-like members wherein one end of each of the flexible rods is inserted through mating apertures in an upright member mounted onto the watercraft so that the rods are bowed outwardly and frictionally held in the stanchion. A canopy is attached between the rods so that the canopy generally appears to be in an elongated V-shaped structure which stretches across a portion of the watercraft between the flexible rods.

13 Claims, 2 Drawing Sheets

(56) References Cited

U.S. PATENT DOCUMENTS

| | | | | |
|---|---|---|---|---|
| 6,968,800 | B1 * | 11/2005 | Becht | B63B 17/00 114/361 |
| 7,392,816 | B2 * | 7/2008 | Porter | A45B 23/00 135/117 |
| 7,549,432 | B2 * | 6/2009 | Sherts | A45B 23/00 135/117 |
| 7,690,390 | B2 * | 4/2010 | Hopkins | B62J 17/08 135/88.03 |
| 7,789,097 | B1 * | 9/2010 | Sotirkys | E04H 15/06 135/88.01 |
| 8,393,343 | B2 * | 3/2013 | Vanvonderen | E04F 11/181 135/16 |
| 8,479,756 | B1 * | 7/2013 | Tieskotter | B62J 17/08 135/88.03 |
| 8,757,185 | B1 | 6/2014 | Muzzio | |
| 8,783,329 | B2 * | 7/2014 | Hsieh | A45B 23/00 135/90 |
| 8,800,469 | B2 * | 8/2014 | Musacchio | B63B 17/02 114/361 |
| 8,991,410 | B2 * | 3/2015 | Surek | E04H 15/02 135/117 |
| 8,991,411 | B1 * | 3/2015 | Neuman | A47C 29/00 135/96 |
| 9,194,152 | B1 * | 11/2015 | Plasencia | E04H 15/06 |
| 2008/0048413 | A1 * | 2/2008 | Salinas | B62J 17/08 280/304.3 |
| 2008/0196754 | A1 * | 8/2008 | Saiz | E04H 15/003 135/98 |
| 2014/0041703 | A1 * | 2/2014 | Funston | E04H 15/54 135/121 |
| 2017/0044792 | A1 * | 2/2017 | Pashandi | E04H 15/58 |

* cited by examiner

CANOPY FOR WATERCRAFT

BACKGROUND OF THE INVENTION

Field of the Invention

The present invention relates generally to canopies and, more particularly, is concerned with a canopy for a watercraft, however, the canopy could be mounted on other separate structures, e.g., a chair.

Description of the Related Art

Devices relevant to the present invention have been described in the related art, however, none of the related art devices disclose the unique features of the present invention.

In U.S. Pat. No. 5,638,849 dated Jun. 17, 1997, Scott disclosed a personal screen device. In U.S. Pat. No. 4,300,798 dated Nov. 17, 1981, Musgrove et al., disclosed a foldable chair with sun shade and tray. In U.S. Pat. No. 4,641,883 dated Feb. 10, 1987, Kato disclosed a foldable support. In U.S. Pat. No. 6,845,780 dated Jan. 25, 2005, Bishirjian disclosed a personal canopy apparatus. In U.S. Pat. No. 8,757,185 dated Jun. 24, 2014, Muzzio disclosed a bimini top for watercraft.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a canopy for a watercraft wherein the canopy is constructed by using a pair of flexible, fiberglass rod-like members wherein one end of each of the flexible members is inserted through mating apertures in an upright member or stanchion mounted onto the watercraft so that the rod-like members are bowed outwardly and frictionally held in the stanchion. The canopy is attached between the rod members by using rings or similar devices placed through eyelets in the canopy so that the canopy generally appears to be in an elongated, somewhat V-shaped structure which stretches across a portion of the watercraft between the flexible members. The canopy is rotatable around the stanchion and the height of the canopy can be adjusted up and down using apertures or the like in the stanchion. Also shown is a cross member running between the flexible rod members so as to provide support underneath the canopy near the middle of the flexible rods. Additionally, there is shown a line attached to a rear end of the canopy so that a head of a user can grasp the line and rotate the canopy around the upright member or stanchion so that the canopy can be positioned in a favorable position suitable to the user and so that the user can cast a rod and reel from underneath the canopy of the present invention.

An object of the present invention is to provide a canopy for a watercraft. A further object of the present invention is to provide a canopy on a watercraft which can be easily adjusted by a user. A further object of the present invention is to provide a canopy for a watercraft which can be raised and lowered and rotated about an upright member used to mount the canopy on the watercraft. A further object of the present invention is to provide a canopy for a watercraft which can be easily operated by a user. A further object of the present is to provide a canopy for a watercraft which can be relatively inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
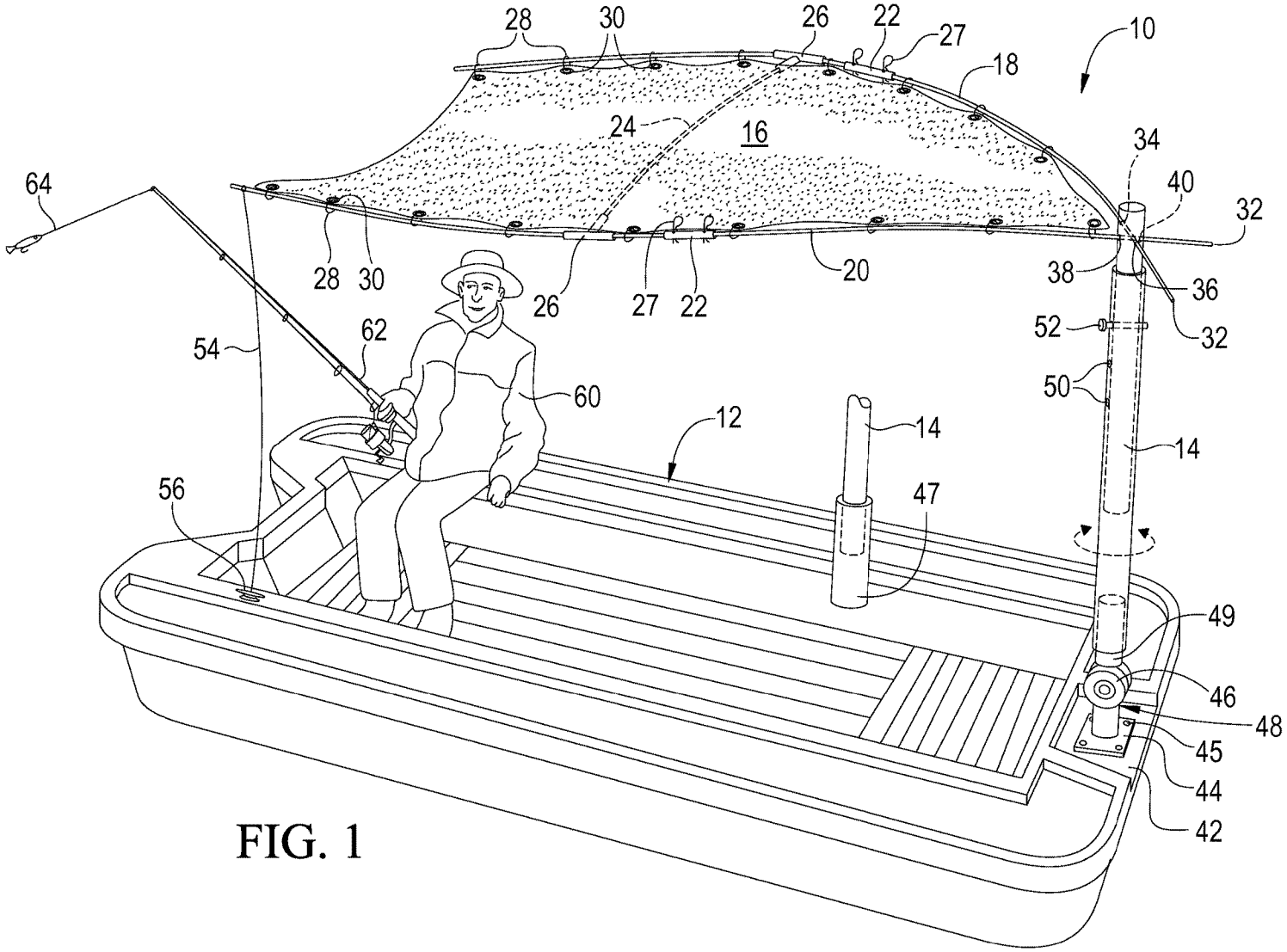
FIG. 1 is a perspective view of the present invention shown in operative connection.

With regard to reference numerals used, the following numbering is used throughout the drawings.

10 present invention
12 watercraft
14 upright support
15 tip of upright support
16 canopy
18 first flexible rod
20 second flexible rod
22 ferrule
24 cross member
26 T connector
27 connector pin
28 ring
30 eyelet
32 end of rod
34 aperture
36 aperture
38 aperture
40 aperture
42 surface of watercraft
44 base
45 fastener
46 rotatable portion
47 rod holder
48 mount for upright support
49 pole mounting portion
50 aperture
52 pin
54 line
56 hardware or cleat
58 ground
60 fisherman
62 rod and reel
64 lure and line

DETAILED DESCRIPTION OF THE PREFERRED EMBODIMENT

Figure 2:
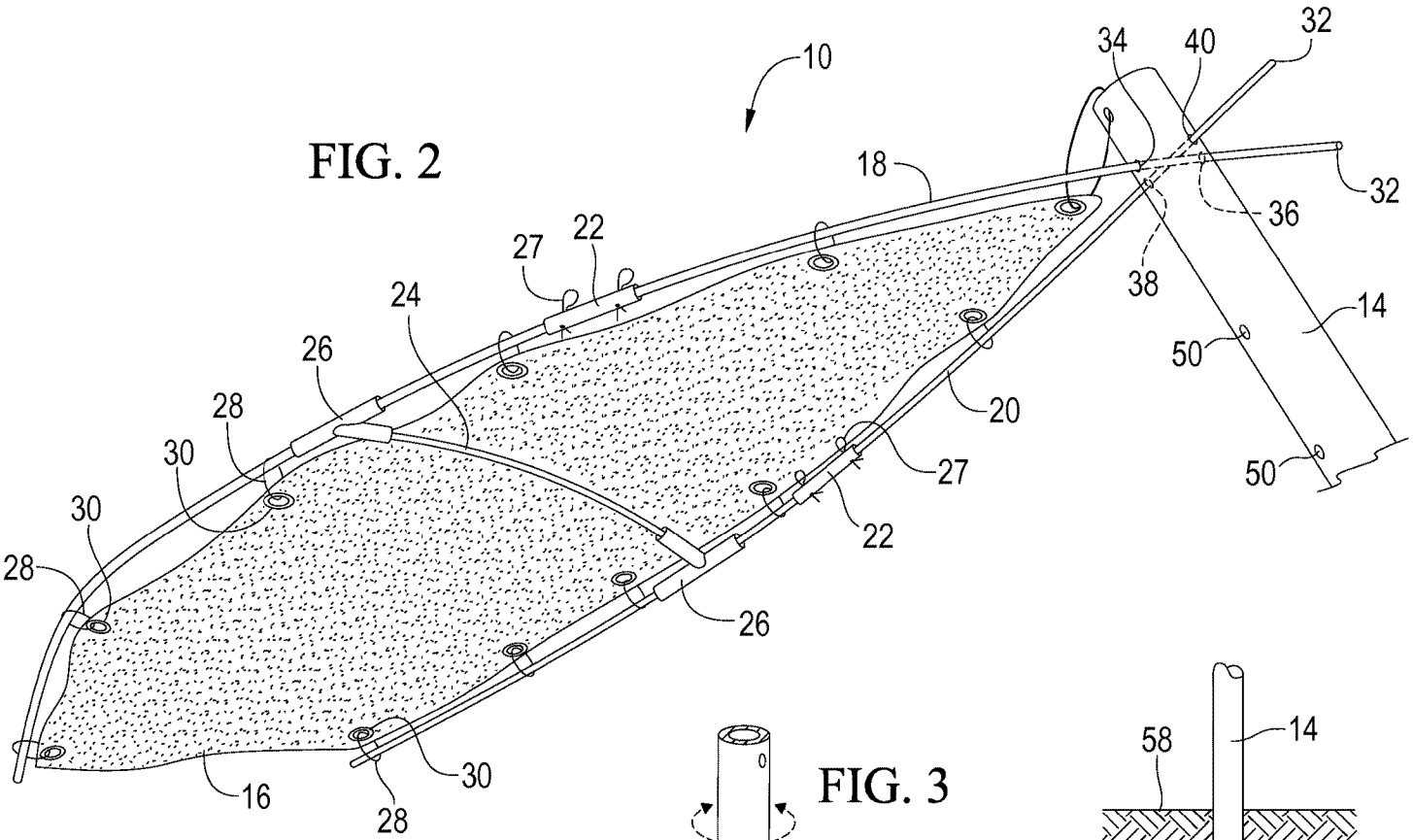
FIG. 2 is an enlarged perspective view of portions of the present invention.
Figure 3:
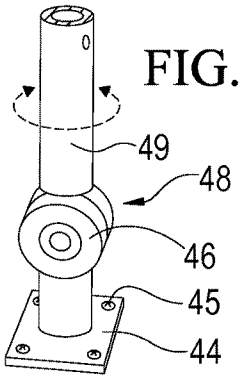
FIG. 3 is a perspective view of a typical mounting bracket for the present invention.

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 3 illustrate the present invention wherein a canopy for a watercraft is disclosed and which is generally indicated by reference number 10.

Turning to FIGS. 1 and 2, therein is shown the present invention 10 showing a watercraft 12 to which is attached an upright support post or stanchion 14 having a canopy 16 disposed thereon. The canopy 16 is supported between a first and second 18, 20 side frame members or rods which are flexible in nature similar to what a fiberglass or graphite composition rod would exhibit and the front tip of canopy 16 may be attached to upright support 14. Each rod 18, 20 may be made of one piece or two pieces and a two piece unit would require a conventional ferrule or the like shown at 22 with connector pins 27 in order to connect the pieces of the rod 18, 20 to each other. Also, a cross member 24 is shown underneath the canopy 16 so as to provide vertical support for the canopy in order to keep it from ripping or tearing as would be caused by wind or movement of the boat or watercraft 12 and T-connectors 26 or the like are shown on each side for connecting an end of the cross bar 24 to each of the flexible rods 18, 20. The canopy 16 is connected to the rods 18, 20 using a plurality of rings 28 passing through multiple eyelets 30 disposed near the edge of the canopy. The flexible rods, 18, 20 are attached to an upper end of the upright support or stanchion 14 by having an end 32 of each rod pass through apertures 34, 36, 38, 40 of the upright support 14. An end of rod 18 extends or passes through aperture 34, 36 and an end of rod 20 passes through aperture 38, 40 as best shown in FIG. 2. This construction technique reduces the cost and time of manufacturing of the present invention 10. The ends of the rod 18, 20 being under inherent resilience force are frictionally held firmly in the aperture pairs 34, 36, 38 40 as the ends 32 of the rods 18, 20 pass completely through the mating opposing walls of the upright support 14. Also shown is an up and down adjustment mechanism for the upright member 14 wherein a plurality of apertures 50 are shown passing through the inner and outer upright support 14 so that the inner upright support is telescopically connected to the outer upright support using a plurality of apertures 50 having a pin 52 pass through a selected aperture pair as would be done in the standard manner by one skilled in the art so as to make the canopy 16 of the present invention 10 height adjustable in an up-down direction. Also shown is a line 54, connected to an end of canopy 16 and having an end tied to cleat 56 which line can be used to control and thereby to move or rotate the canopy 16 about the watercraft 12 to a user selected position. Also shown is a fisherman 60 in boat 12 holding a rod and reel 62 in his hand with a lure and line 64 thereon illustrating how a user can cast from underneath the canopy 16. An alternate mounting means for the upright support post 14 is shown by rod holder 47 disposed on an inside wall of the boat 12 with a lower end of the post 14 inserted in the rod holder. Also shown is an exemplary mounting device 48 for connecting the upright support 14 to a surface 42 of the watercraft 12 or the like wherein the mounting device has a base 44 for receiving fasteners 45 extending into the surface 42 and a middle portion 46 which is generally pivotable and/or rotatable and a pole mounting portion 49 to which the upright support 14 is connected.

Turning to FIG. 3, therein is shown an enlarged exemplary mounting device 48 for connecting the lower end of upright support 14 to a surface 42 of the watercraft 12 or the like wherein the mounting device has a base 44 for receiving fasteners 45 and a middle portion 46 which is generally pivotable and/or rotatable and a pole mounting portion 49 to which the upright support 14 is connected. Many different types of mounting devices 48 could be used with upright support 14 for connection to many types of separate structures such as chairs or the like.

Figure 4:
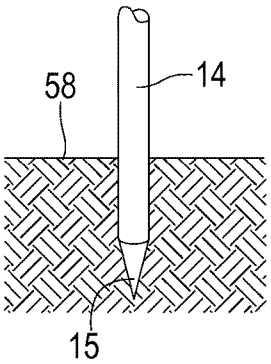
FIG. 4 is an elevation view of portions of the present invention.

Turning to FIG. 4, therein is shown an enlarged view showing the lower end of the upright support 14 having a tip 15 thereon for insertion into a different support structure such as the ground 58 as would occur with sand at a beach.

Additional explanation of the present invention 10 is hereby provided with reference to all the figures wherein a lightweight canopy 16 for a boat 12 is disclosed which is fully adjustable up and down and rotatable in a 360 degree arc around the stanchion 14 using a line 54 which would allow a fisherman 60 underneath the canopy to cast while standing or sitting underneath the canopy. The canopy 16 also provides protection from sunrays and rain. The canopy 16 which is made of sheet of flexible material made of nylon-like material is supported by a pair of solid flexible, fiberglass or graphite rods 18, 20 about ½ inch in diameter and the canopy is attached to the rods using eyelets 30 with simple connectors 28 being run through the eyelets and around the rods. The inherent resilience of the rods 18, 20 bias the flexible fiberglass rods away from each other providing an effective amount of tension for maintaining the canopy in a stretched out disposition between the rods wherein the rods are each bowed outwardly away from each other. Front ends 32 of the fiberglass rods 18, 20 are each passed through holes 34-40 placed in opposite sides of an upright support PVC pipe or post 14 or like type support post or stanchion which support post is mounted onto a boat 12 or the like at its lower end. The canopy 16 would be easy to use and relatively inexpensive to manufacture. Also, the solid flexible, fiberglass rods 18, 20 may be jointed at 22 so the system could be broken down and folded for storage. Also, the rear ends of the flexible, fiberglass rods 18, 20 may be squeezed inwardly toward each other and tied to each other for securement while the boat 12 is being operated at high speed in a forward direction. Also, in addition to watercraft 12, the canopy 16 could be mounted on many types of separate support structures such as picnic tables, trailers, pickup trucks, chairs, in the ground or the like. Canopy 16 may be made of tarp-like material and may be waterproof. PVC post 14 has an inner member about 1½ inch in diameter and an outer member about 2 inch in diameter. Ferrules 22 and T-connectors 26 could be made of fiberglass or aluminum or the like.

A summary of the present invention 10 making reference to FIGS. 1-4 follows wherein a canopy 16 for being mounted on a separate structure such as a watercraft 12 or in the ground 58 or rod holder 47 includes an upright support post 14 having upper and lower ends; first and second flexible rods 18, 20, each flexible rod having first, front 32 and second, rear ends; a first end of each flexible rod extending through an upper end of said upright support post, wherein the flexible rods are substantially horizontally disposed; and, a sheet of material having a first edge disposed on said the first flexible rod and a second edge disposed on the second flexible rod so that the sheet of material forms a canopy extending between the first and second flexible rods and substantially from the first end of each flexible rod to the second end of each flexible rod. Wherein, the upright support post is adjustable in height using apertures 50 and a pin 52 and is rotatable in a 360 degree arc. Also, shown is a cross member 24 having first and second ends extending underneath the sheet of material 16 having the first end of the cross member connected to the first flexible rod and the second end of the cross member connected to the second flexible rod at 26. Wherein the first end 32 of each flexible rod 18, 20 is frictionally held in the plurality of apertures 34, 36, 38, 40 substantially perpendicular to the upper end of the upright support post 14. The angle formed between the rods 18, 20 (expected to be about 60 to 120 degrees) with respect to each other is effectively sized so that the rods become bowed enough to provide enough lateral tension to support the canopy 16 in a stretched out disposition.

I claim:

1. A canopy mounted on a separate structure, comprising:

a) an upright support post having upper and lower ends, said lower end mounted fixed in place on said structure, and said upper end being rotatable with respect to said lower end;

b) first and second flexible rods, each flexible rod having first and second ends;

c) said first end of each said flexible rod extending through and held firmly in apertures in said upper end of said upright support post, wherein said flexible rods are substantially horizontally disposed and extend outwardly from said upright support post at an angle to each other in the range of 60 to 120 degrees and terminating at said seconds ends;

d) a sheet of material having a first edge disposed on and attached to said first flexible rod and a second edge disposed on and attached to said second flexible rod so that said sheet of material forms a canopy extending between said first and second flexible rods and substantially from said first end of each said flexible rod to said second end of each said flexible rod;

e) said flexible rods being constructed so as to bias the rods away from each other providing an effective amount of tension for maintaining the sheet of material in a stretched out disposition; and f) means to rotate said upper end of said upright support post along with said flexible rods about said lower end of said support post to reposition said sheet of material.

2. The canopy of claim 1, wherein a top view of said canopy resembles a V-shape.

3. The canopy of claim 1, wherein said upright support post is adjustable in height.

4. The canopy of claim 1, further comprising a cross member having first and second ends, said cross member extending between said first and second flexible rods underneath said sheet of material having said first end of said cross member connected to said first flexible rod and said second end of said cross member connected to said second flexible rod.

5. The canopy of claim 1, wherein said means to rotate comprises a line connecting said second end of one of said flexible rods to said structure.

6. The canopy of claim 5 in which said structure comprises a watercraft, and said line is attached to a cleat on said watercraft whereby the canopy can be moved or rotated to a user selected position.

7. A method for assembling a canopy, the canopy for being mounted on a separate structure, comprising the steps of:

a) providing an upright support post having upper and lower ends, said lower end being mounted fixed in place on said structure, and said upper end being rotatable with respect to said lower end;

b) providing first and second flexible rods, each flexible rod having first and second ends;

c) extending the first end of each flexible rod through the upper end of the upright support post so that the flexible rods are substantially horizontally disposed, said rods extending outwardly at an angle to each other in the range of 60 to 120 degrees and terminating in free second ends;

d) extending a sheet of material between the first and second flexible rods wherein a first edge thereof is disposed on the first flexible rod and a second edge thereof is disposed on the second flexible rod so that the sheet of material forms a canopy extending between the first and second flexible rods and substantially from the first end of each flexible rod to the second end of each flexible rod, wherein the flexible rods bias away from each other providing an effective amount of tension for maintaining the sheet of material in a stretched out disposition; and e) using means to rotate said upper end of said upright support post along with said flexible rods about said lower end of said support post to reposition said sheet of material.

8. The method of claim 7, wherein a top view of the canopy resembles a V-shape.

9. The method of claim 7, wherein the upright support post is adjustable in height.

10. The method of claim 7, further comprising the step of providing a cross member having first and second ends, the cross member extending between the first and second flexible rods underneath the sheet of material so that the first end of the cross member is connected to the first flexible rod and the second end of the cross member is connected to the second flexible rod.

11. The method of claim 7, wherein said means to rotate comprises a line connecting said second end of one of said flexible rods to said structure.

12. The method of claim 11 in which said structure comprises a watercraft, and said line is attached to a cleat on said watercraft.

13. The method of claim 7, further comprising the step of making each of the flexible rods in multiple pieces so that the canopy is capable of being folded for storage.

* * * * *